US007987896B2

(12) United States Patent
Schmidt

(10) Patent No.: US 7,987,896 B2
(45) Date of Patent: Aug. 2, 2011

(54) METHOD FOR GUIDING A CAST MATERIAL OUT OF A CASTING CHAMBER OF A CASTING SYSTEM, AND CASTING SYSTEM FOR CASTING A CAST MATERIAL

(75) Inventor: Hans-Joachim Schmidt, Idar-Oberstein (DE)

(73) Assignee: Siemens Aktiengesellschaft, Munich (DE)

( * ) Notice: Subject to any disclaimer, the term of this patent is extended or adjusted under 35 U.S.C. 154(b) by 128 days.

(21) Appl. No.: 12/522,440

(22) PCT Filed: Jan. 21, 2008

(86) PCT No.: PCT/EP2008/050633

§ 371 (c)(1),
(2), (4) Date: Jul. 8, 2009

(87) PCT Pub. No.: WO2008/090121

PCT Pub. Date: Jul. 31, 2008

(65) Prior Publication Data

US 2010/0038048 A1 Feb. 18, 2010

(30) Foreign Application Priority Data

Jan. 22, 2007 (DE) ..... 10 2007 004 053

(51) Int. Cl.
*B22D 11/20* (2006.01)

(52) U.S. Cl. ..... 164/454; 164/413; 164/477; 164/451

(58) Field of Classification Search ..... 164/454, 164/413, 477, 451
See application file for complete search history.

(56) References Cited

U.S. PATENT DOCUMENTS 5,018,569 A * 5/1991 Burau et al. ..... 164/454
2005/0011629 A1 1/2005 Weyer et al.

FOREIGN PATENT DOCUMENTS

DE 3822939 C 10/1989
DE 4039478 A 6/1992
DE 10236368 A1 9/2003

(Continued)

OTHER PUBLICATIONS

German Office Action, German Application No. 102007004053.0-24, 3 pages.
International Search Report, PCT/EP2008/050633, 13 pages.

*Primary Examiner* — Jessica L Ward
*Assistant Examiner* — Erin B Saad
(74) *Attorney, Agent, or Firm* — King & Spaldng L.L.P.

(57) ABSTRACT

In a method for guiding a cast material out of a casting chamber of a casting system, the cast material is discharged from a casting chamber by means of a succession of guiding rollers and rolling rollers. A rolling roller exerts a rolling force on the cast material to reduce the thickness of the cast material, whereas a guiding roller, which simply guides, exerts no rolling force on the cast material. At least the rolling rollers are driven by a drive, each drive applied under load. Because the rolling force of at least one rolling roller is detected, and the load of the drive of this rolling roller is controlled according to the detected rolling force, a method can be provided by which the stability of the casting speed is increased, and a significant reduction of the thickness of a cast material is achieved.

20 Claims, 2 Drawing Sheets

FOREIGN PATENT DOCUMENTS

| | | | |
|---|---|---|---|
| DE | 202007001224 | | 5/2007 |
| EP | 0350431 | A2 | 1/1990 |
| EP | 0463203 | A1 | 1/1992 |
| EP | 0732979 | A1 | 9/1996 |
| EP | 0804981 | A1 | 11/1997 |
| EP | 1068914 | A1 | 1/2001 |
| JP | 60196202 | A | 10/1985 |

* cited by examiner

METHOD FOR GUIDING A CAST MATERIAL OUT OF A CASTING CHAMBER OF A CASTING SYSTEM, AND CASTING SYSTEM FOR CASTING A CAST MATERIAL

CROSS-REFERENCE TO RELATED APPLICATIONS

This application is a U.S. National Stage Application of International Application No. PCT/EP2008/050633 filed Jan. 21, 2008, which designates the United States of America, and claims priority to German Application No. 10 2007 004 053.0 filed Jan. 22, 2007, the contents of which are hereby incorporated by reference in their entirety.

TECHNICAL FIELD

The invention relates to a method for guiding a cast material out of a casting chamber of a casting system, wherein the cast material is discharged from the casting chamber by means of a succession of guiding rollers and rolling rollers, wherein a rolling roller exerts a rolling force on the cast material to reduce the thickness of the cast material, whereas an only guiding roller exerts no rolling force on the cast material, and wherein at least the rolling rollers are driven by a drive, each drive applied under load.

The invention also relates to a casting system for casting a cast material, in particular a strand or a billet strand, wherein the cast material can be discharged from a casting chamber by means of a succession of guiding rollers and rolling rollers acting on the cast material, wherein a rolling roller exerts a rolling force on the cast material to reduce the thickness of the cast material, whereas a guiding roller exerts no rolling force on the cast material, wherein at least the rolling rollers can be driven independently of one another. Furthermore, the invention relates to an associated control device, an associated computer program product and a data carrier with a computer program product stored on it.

BACKGROUND

A casting system may be, for example, a strand casting system, a billet strand casting system or else a die-operated continuous casting and rolling system. In the case of a strand casting system, a strand, generally a metal strand, in particular a steel strand, is drawn off from a die by means of driven rollers or pairs of rollers. In the case of a billet strand casting system, generally a plurality of extruded billets are cast in a die, generally two to six extruded billets.

Generally, electrical driven rollers or pairs of rollers are provided for guiding a cast material, for example a strand or an extruded billet, when it is being drawn off. For example, a strand is drawn off substantially vertically out of the die and transferred into a substantially horizontal direction by means of a casting bow.

In order to reduce the effort involved in rolling in a rolling mill, in the case of casting systems the rollers or pairs of rollers are advantageously used not only for guiding the strand but also for reducing the thickness of the cast material.

Critical variables in the casting of a cast material are the casting speed and the desired final thickness, if a thickness reduction is envisaged.

The rotational speed of the drives for the rollers or the drives for the pairs of rollers may serve for setting the casting speed of the cast material. For example, the mean value of the speed of all the drives is kept constant for this purpose. As a result, the casting speed drops as the thickness of the strand is increasingly reduced. However, since the driven rollers rotate with the same radial speed, adequate allowance cannot be made for a change in the speed of a portion of the cast material that results from the thickness reduction. Therefore, in the case of such a method, generally no thickness reduction of the cast material is envisaged for this reason.

Alternatively, it may be provided that the rollers or pairs of rollers acting on the cast material are driven by means of drives which all run with the same load. The pairs of rollers together with the drive and means for producing rolling force are referred to as the reduction stand. In the case of a dynamic thickness reduction—dynamic since the rolling forces depend on the time-variable phase response within the strand—of the strand or billet, operation of the drives with the same load has the consequence that, with low vertical force or rolling force on the strand, the frictional forces are so low that the roller loses adherence and does not transfer any forward motion, or transfers reduced forward motion, to the strand. Moreover, increased friction occurs in the case of rollers with increased vertical force or increased rolling force on account of the evenly distributed load on the drives, and increased friction leads to a slowing of the circumferential speed of the roller concerned. This leads to a slowing of the speed of the strand or to the cast material coming to a standstill in the casting system.

On account of a dynamic distribution of forces in the case of roller drives operated with the same load—the thickness reduction of the strand over the various pairs of rollers is highly process-dependent and dynamic during casting—instabilities in the casting speed occur. In particular, the dynamics of the thickness reduction are determined in part by the calculated liquid core component within a strand, which is determined by appropriate models that are not the subject of this application.

Patent specification EP 0 463 203 B1 discloses a guiding method for electrical drives of rollers of a strand casting system in which the strand is drawn off out of the die of the strand casting system by the driven rollers, the drives of which are individually controlled by means of controllers, and can be reduced in its thickness. A disadvantage of this teaching is that the drives consequently cannot be controlled adequately flexibly with regard to use within casting systems with reduction stands.

SUMMARY

According to various embodiments, an apparatus and a method can be provided with which the stability of the casting speed can be increased and a significant reduction of the thickness of a cast material can be achieved.

According to an embodiment, in a method for guiding a cast material out of a casting chamber of a casting system, wherein the cast material is discharged from the casting chamber by means of a succession of guiding rollers and rolling rollers, wherein a rolling roller exerts a rolling force on the cast material to reduce the thickness of the cast material, whereas an only guiding roller exerts no rolling force on the cast material, and wherein at least the rolling rollers are driven by a drive, each drive applied under load, the rolling force of at least one rolling roller is detected and in that the load of the drive of this rolling roller is controlled in dependence on the rolling force detected.

According to a further embodiment, a total load can be determined as a sum of the loads of the drives of the rolling rollers and a total rolling force can be determined as a sum of the rolling forces exerted by the rolling rollers, wherein the loads of the drives assigned to the rolling rollers are controlled in such a way that they behave with respect to the total load in the same way as the rolling forces of the respectively assigned rolling rollers behave with respect to the total rolling force. According to a further embodiment, an additional rotational-speed setpoint value may additionally be determined for controlling the load of a drive, in order to adapt a rotational speed of a roller to a rolling-induced increase in the speed of a rolled portion of cast material. According to a further embodiment, the additional rotational-speed setpoint value may be calculated according to $$\Delta n_{isoll}=p\cdot(I_{i\,ist}-I_i)\cdot n_N/I_N,$$

where $I_{i\ ist}$ is the actual current of the ith drive, $I_i$ is the force-dependent setpoint value of the ith drive, p is a constant, $n_N$ is a nominal rotational speed and $I_N$ is a nominal current of the drive. According to a further embodiment, one of the guiding rollers may be driven in such a way by a drive to which a load is applied and a pressing force not reducing the thickness of the cast material may be exerted on the cast material in such a way that a prescribable casting speed of the cast material is set. According to a further embodiment, the casting speed may be kept constant. According to a further embodiment, the loads of the drives of rollers arranged downstream of the roller setting the casting speed may be controlled in dependence on the detected load of the drive assigned to the roller setting the casting speed. According to a further embodiment, the casting speed of the cast material can be measured by means of the roller setting the casting speed. According to a further embodiment, the load of the drive assigned to the measuring roller may be detected, and from this a load-offset value for the loads of the drives assigned to rollers arranged downstream of the measuring roller may be determined and the drives can be controlled on the basis of this load-offset value. According to a further embodiment, the load-offset value can be determined by means of a PI controller. According to a further embodiment, the load of the drive assigned to the measuring roller can be set to a prescribable, constant load value. According to a further embodiment, the torque of the drive may be used as a measure of the load thereof. According to a further embodiment, the active current of the drive can be used as a measure of the load thereof.

According to another embodiment, a control device for a casting system may have a machine-readable program code which comprises control commands that make the control device carry out the above described method.

According to another embodiment, a computer program product for a control device which can be stored on a data carrier may comprise a machine-readable program code that is suitable for making a control device carry out the above described method when the computer program product is run on the control device.

According to yet another embodiment, a data carrier may store the computer program product as described above.

According to yet another embodiment, a casting system for casting a cast material, in particular a strand or a billet strand, wherein the cast material can be discharged from a casting chamber by means of a succession of guiding rollers and rolling rollers acting on the cast material, wherein a rolling roller exerts a rolling force on the cast material to reduce the thickness of the cast material, whereas a guiding roller exerts no rolling force on the cast material, wherein at least the rolling rollers can be driven independently of one another, may comprise means for detecting a rolling force that is exerted on the cast material by one of the rolling rollers and a control device as described above.

BRIEF DESCRIPTION OF THE DRAWINGS

Further advantages of the invention emerge from a schematically represented exemplary embodiment explained below. In the drawing.

DETAILED DESCRIPTION

Figure 1:
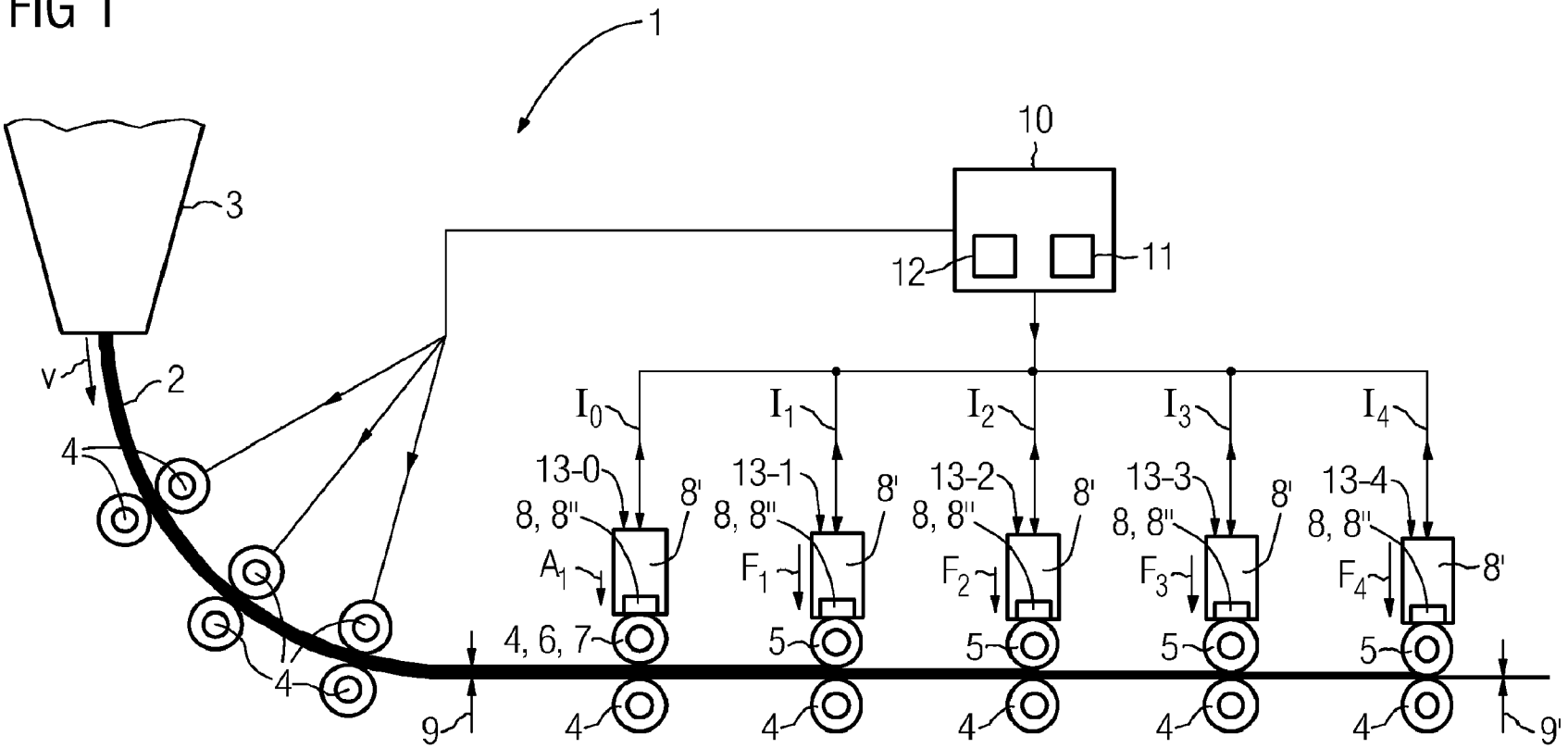
FIG. 1 shows a strand casting system for casting a metal strand.

According to an embodiment, in a generic method of the type mentioned at the beginning, the rolling force of at least one rolling roller is detected and the load of the drive of this rolling roller is controlled in dependence on the rolling force detected. An improved distribution of the power introduced to the cast material by the rolling rollers causes the advancing energy available for the cast material to be increased. Consequently, a greater thickness reduction of the cast material is made possible, and at the same time the slowing of the casting speed of the cast material that is possibly caused by high rolling forces is avoided. Sticking of the cast material in the casting system can therefore be obviated. Moreover, the transmission of the advancing energy to the cast material is improved by the load of the drives of the at least one rolling roller that is set according to various embodiments, whereby the quality of the surface of the cast material is increased in comparison with a surface of the cast material that is produced according to the methods known from the prior art.

In an embodiment, a total load is determined as a sum of the loads of the drives of the rolling rollers and a total rolling force is determined as a sum of the rolling forces exerted by the rolling rollers, wherein the loads of the drives assigned to the rolling rollers are controlled in such a way that they behave with respect to the total load in the same way as the rolling forces of the respectively assigned rolling rollers behave with respect to the total rolling force. This can be reproduced by the following equation:

$$I_i = F_i \cdot \frac{I_{tot}}{F_{tot}}$$

Therefore, a simple rolling-force-dependent distribution of the drive loads of the drives driving the rolling rollers can be made possible by the aforementioned equation.

In a further embodiment, an additional rotational-speed setpoint value is additionally determined for controlling the load of a drive, in order to adapt a rotational speed of a roller to a rolling-induced increase in the speed of a rolled portion of cast material. In the case of the present method, this is generally dependent on the load of the drive. In an advantageous way, the additional rotational-speed setpoint value can be calculated according to the following equation:

$$\Delta n_{isoll} = p \cdot (I_{i\,ist} - I_i) \cdot \frac{n_N}{I_N},$$

where $I_{i\ ist}$ is the actual current of the ith drive, $I_i$ is the force-dependent setpoint value of the ith drive, p is a constant, $n_N$ is a nominal rotational speed and $I_N$ is a nominal current of the drive.

This allows a dynamic adaptation of the rotational speed to the loads of the drives. A nominal rotational speed of the drive to which a nominal current is applied is a characteristic of a drive which, with this way of determining the additional rotational-speed value, is a basis for determining said additional rotational-speed value.

In a further embodiment, one of the guiding rollers is driven in such a way by a drive to which a load is applied and a pressing force not reducing the thickness of the cast material is exerted on the cast material in such a way that a prescribable casting speed of the cast material is set. The roller setting the casting speed of the cast material has a load setpoint value applied to it, so that an adaptation of the load to the load setpoint value leads to the setting of a desired casting speed. In an advantageous way, the roller setting the casting speed does not have an additional rotational-speed setpoint value applied to it.

In particular, it is advantageous that the casting speed of the cast material is kept constant. This in turn means that the load setpoint value for the drive of the roller setting the speed is normally constant. If the casting speed is to be changed, i.e. increased or reduced, in comparison with the present value of the casting speed, the load setpoint value for the speed-setting roller is changed. Preferably, the drive assigned to the setting roller internally corrects the load, so that the prescribed setpoint value of the load is set on the drive.

In a further embodiment, the loads of the drives of rollers arranged downstream of the speed-setting roller are controlled in dependence on the detected load of the drive assigned to the roller setting the casting speed. Therefore, if the casting speed is to be changed, i.e. the load of the drive of the speed-setting roller is changed, this changing of the load of the drive of the speed-setting roller, and consequently the intention of changing the casting speed, is included in the process of controlling the drives of the downstream rolling rollers.

In particular, it is advantageous to measure the casting speed of the cast material by means of the roller setting the casting speed. This is so since it dispenses with the need for an additional measuring device, for example an additional measuring roller or a measuring device for contactless determination of the casting speed. This also obviates the need for the maintenance work to be carried out for this measuring roller or measuring device to achieve a measurement of the casting speed with a certain accuracy. This maintenance work that is now not required would have additionally involved great effort, since the measuring device for measuring the casting speed would have to have been used in an area of the casting system that is dangerous for personnel. All this can be avoided by the speed-setting roller also measuring the casting speed of the cast material.

In a further embodiment, the load of the drive assigned to the measuring roller is detected and from this a load-offset value for the loads of the drives assigned to rollers arranged downstream of the measuring roller is determined and the drives are controlled on the basis of this load-offset value. This allows the effect to be achieved that the drives of the roller arranged downstream of the measuring roller are controlled by means of the load-offset value in such a way that the downstream rolling rollers, which can be viewed as a unit, relieve the measuring roller in every operative direction. This means, for example, that a changing of the casting speed of the cast material that is not desired and is caused by the dead weight of the discharged cast material is compensated. In a further embodiment, a PI controller is used for determining the load-offset value. In the PI controller, a slightly positive active current may be prescribed as a setpoint value for determining the load-offset value. In particular, this can achieve the effect that the rollers arranged downstream of the measuring roller relieve the measuring roller in every operative direction, in that the drives assigned to the rollers arranged downstream of the measuring roller are controlled by means of the load-offset value determined in this way.

In a further embodiment, the load of the drive assigned to the measuring roller is set to a prescribable constant load value. Such a setting of the load of the drive assigned to the measuring roller provides a constant slip between the measuring roller and the cast material even when there is low pressing force of the measuring roller onto the cast material. As a result, the measuring error occurring in the measurement of the casting speed is also reduced.

A part of the object that is assigned to the apparatus is achieved by a control device for a casting system, with a machine-readable program code which comprises control commands that make the control device carry out a method as claimed in one of claims 1 to 13.

A central control device, which controls the drives of the guiding and rolling rollers in a way according to further embodiments, and the associated casting system are advantageously provided.

Furthermore, a part of the object that is assigned to the apparatus in the case of a generic casting system of the type mentioned at the beginning is achieved by providing means for detecting a rolling force that is exerted on the cast material by one of the rolling rollers and a control device as claimed in claim 14, by means of which a load of a drive assigned to a rolling roller can be set in dependence on that rolling force that this rolling roller exerts on the cast material. An improved distribution of the power introduced to the cast material by the rolling rollers causes the advancing energy available for the cast material to be increased. Consequently, a greater thickness reduction of the cast material is made possible, and at the same time the slowing of the casting speed of the cast material that is possibly caused by high rolling forces is avoided. Sticking of the cast material in the casting system can therefore be obviated. Moreover, the transmission of the advancing energy to the cast material is improved by the load of the drives of the at least one rolling roller that is set according to various embodiments, whereby the quality of the surface of the cast material is increased in comparison with a surface of the cast material that is produced according to the methods known from the prior art.

Within the scope of this application, rolling force is understood as meaning a force that is suitable for bringing about a plastic, permanent deformation of a cast material. A roller that exerts such a force on the cast material is referred to as a rolling roller. Apart from the rolling rollers, guiding rollers are provided, intended for example for defining the direction, in particular of a casting bow. A reduction of the thickness brought about by elastic deformation of the cast material is not to be regarded as a reduction of the thickness within the scope of this application, since this reduction of the thickness is reversible and not permanent. Within the scope of this application, a succession of rollers is understood as also including a succession of pairs of rollers in which at least one roller of a pair can be driven. The various embodiments make it possible in particular to exploit the fact that, with a higher rolling force on the cast material, a higher torque can act on the cast material, without the adherence of the rolling roller on the cast material being lost.

In a further embodiment, means for detecting a total load as a sum of the loads of the drives driving the rolling rollers and means for detecting a total rolling force as a sum of the rolling forces exerted by the rolling rollers on the cast material are provided, wherein the loads of the drives assigned to the rolling rollers are controlled by means of the control device in such a way that, for each drive, the ratio of the load to the total load is substantially equal to the ratio of the rolling force exerted by the rolling roller assigned to this drive to the total rolling force. This is a simple linear relationship, which in response to dynamic changing of the rolling force leads to dynamic changing of the load of the drives.

As a result, a stable casting speed can be achieved at any time, with at the same time good adherence of the rolling rollers. The means for detecting a total load may detect a total load of the drives of the rolling rollers directly or determine the total load from the individual loads of the drives by forming a sum of the individual loads. This applies analogously to the means for detecting a total rolling force. The means for detecting a total force are generally formed in such a way that they use the individual rolling forces exerted by the rolling rollers on the cast material to determine a total rolling force from these by summation. A decrease in thickness of the cast material by the rolling can also be used for determining a total rolling force.

These variables are fed to a control device, which calculates the loads of the individual drives according to the following relationship:

$$I_i = F_i \cdot \frac{I_{tot}}{F_{tot}},$$

where $I_i$ is the value of the active current to be set for the drive of the rolling roller i, $F_i$ is the rolling force exerted on the cast material by the rolling roller i, $I_{tot}$ is the total load and $F_{tot}$ is the total rolling force.

In a further embodiment, means for determining an additional rotational-speed setpoint value for controlling at least one of the drives are provided. The reduction of the thickness of the cast material caused by the rolling force of the rolling rollers brings about an increase in the speed of the portions of cast material on the basis of the mass flow law. In order to make allowance for this increase in speed caused by the thickness reduction for downstream rolling rollers, it is required to determine an additional rotational-speed setpoint value. This makes allowance for the changes in speed of the portions of cast material to be rolled by previous rolling and allows an increase in the stability of the casting speed. In particular, it is advantageous to determine the additional rotational-speed setpoint value by means for determining the additional rotational-speed setpoint value that are formed in such a way that the additional rotational-speed setpoint value is calculated according to the relationship:

$$\Delta n_{isoll} = p \cdot (I_{i\,ist} - I_i) \cdot \frac{n_N}{I_N},$$

where $I_{i\ ist}$ is the actual current of the ith drive, $I_i$ is the force-dependent setpoint value of the ith drive, p is a constant, $n_N$ is a nominal rotational speed and $I_N$ is a nominal current of the drive.

On the basis of the simple relationship and the variables contained therein for calculating the additional rotational-speed setpoint value, the additional rotational-speed setpoint value can be determined in real time and the control device can set an additional rotational-speed setpoint value determined for a specific drive. A nominal rotational speed of the drive to which a nominal current is applied is a characteristic of a drive which, with this way of determining the additional rotational-speed value, is a basis for determining said additional rotational-speed value.

In a further embodiment, the load of a drive assigned to a guiding roller and a pressing force exerted by the guiding roller on the cast material are set in such a way that a prescribable casting speed of the cast material is set. For this purpose, the drive may be prescribed a setpoint value for the load, so that the circumference of the guiding roller assigned to this drive turns with a desired casting speed. In this case, the roller preferably does not have an additional rotational-speed setpoint value applied to it. The load setpoint value for this drive is preferably constant—unless a changing of the desired casting speed of the cast material is to be achieved. Then, the setpoint value of the load of the drive is correspondingly adapted and the load of the drive is changed in such a way that the desired casting speed of the cast material is set.

In a further embodiment, the control device is formed in such a way that the loads of the drives of a roller arranged downstream of the roller setting the casting speed are set in dependence on the detected load of the drive assigned to the roller setting the casting speed. In other words, if the load of the drive of the guiding roller rises above a load limit value, it is desired to increase the casting speed of the cast material. If, on the other hand, the load falls below a prescribable load limit value, it is obviously prescribed by the changed setpoint value of the load of the drive that the casting speed of the cast material is to be reduced.

It is therefore particularly advantageous to use the load of the drive of the speed-setting roller as a controlled variable for the load of the drives assigned to the roller arranged downstream of the roller setting the casting speed. This allows the rolling rollers arranged downstream of the guiding roller also to be quickly set to changed casting conditions, in particular to changed casting speeds, without effects of tension or effects of compression occurring on the cast material during the changing of the casting speed.

In particular, it is advantageous that the roller setting the casting speed is designed for measuring the casting speed of the cast material. This obviates the need for an additional measuring device for measuring the casting speed of the cast material. In spite of dispensing with this need, the operational reliability increases and there is no need for the otherwise necessary maintenance of this measuring device in a technically inefficient area, on the hot cast material.

In a further embodiment, a PI controller is provided for determining a load-offset value from the detected load of the drive assigned to the roller measuring the casting speed, with which the load of a drive assigned to the roller arranged downstream of the measuring roller can be controlled. As a result, it can be made possible for the rollers arranged downstream of the measuring roller to run as neutrally as possible along with the cast material, which has a casting speed different from zero. In particular, by output of an appropriate load-offset value, a PI controller can make the control device control the loads of the drives of the rollers arranged downstream of the guiding roller in such a way that the measuring roller is relieved in every operative direction by the downstream rolling rollers.

In a configurational variant, the control device is formed in such a way that the load of the drive of the roller measuring the casting speed is kept at a constant value. This ensures that the measuring roller has a constant slip even when there is low pressing force on the cast material. The measuring error occurring in the measurement is significantly reduced as a result, since the measuring roller acts on the cast material with a constant direction and consistent intensity. Should a further increase in the measuring accuracy be required, the slip otherwise occurring in a dynamic form in the case of measurement by means of driven rollers can be compensated here by much simpler methods on account of its now almost static occurrence.

In a further embodiment, the means for detecting a load of a drive detect the torque thereof. As an alternative to, or at the same time as, the detection of the torque, the active current of the drive may be detected by the means for detecting a load. A load of a drive can be reliably determined both by the torque and by the active current. In practice, and in particular with regard to the equations disclosed within the scope of this application, an active current may possibly be used with preference as a measure of the load, because this is generally easier to measure than a torque. However, torque and active current are equivalent for the determination of a load of a drive.

FIG. 1 shows a casting system 1, which is formed as a strand casting system, for casting a cast material 2, which is formed as a strand. Furthermore, FIG. 1 shows a casting chamber 3, which is formed as an open-ended die, out of which the strand 2 is discharged. After the strand 2 has emerged substantially vertically from the open-ended die 3 at the casting speed v, guide rollers 4 deflect the strand 2 into a horizontal direction. The strand has an initial thickness 9, which is to be reduced to a final thickness 9'. For this purpose, a plurality of reduction stands 13-0, 13-1, 13-2, 13-3, 13-4 are used. The rolling stands are referred to hereafter as **13-*i*, i=0 . . . 4, for short. By means of a reduction stand 13-*i*, a rolling force F that leads to a reduction of the thickness 9 of the strand 2 can be exerted on the strand 2**. A reduction of the thickness of the strand already taking place during the casting facilitates subsequent rolling in a rolling mill.

A consequence of a reduction of the thickness 9 of the strand is that a portion of the strand that is reduced in thickness 9 increases its speed on account of maintaining volume. There are therefore different speeds of the portions of strand between rolling reduction stands **13-*i* and 13-*i*+1**.

In this exemplary embodiment, a reduction stand **13-*i*, i=0 . . . 4, has two rollers, between which the strand 2 is guided. In the case of the reduction stands 13-*i*, i=0 . . . 4, shown in FIG. 1, only the rollers of the reduction stands 13-*i*, i=0 . . . 4, that are arranged above the strand 2 can be driven by means of a drive 8. The rollers of the reduction stands 13-*i*, i=0 . . . 4, that are arranged below the strand 2 cannot be driven, and merely serve as a rotatably mounted abutment for the exertion of a force on the strand 2** by means of the upper roller.

Each of the rollers comprised by the reduction stands **13-*i*, i=0 . . . 4, that are arranged above the strand 2 can therefore be operated as rolling rollers 5. For this purpose, an ith rolling roller 5 is pressed onto the strand 2 with a rolling force $F_i$. However, an upper roller of a reduction stand 13-*i*, i=0 . . . 4, does not necessarily have to act as a rolling roller 5. If, for example, the force for a roller is chosen so low that no plastic thickness reduction of the strand takes place, this roller is regarded as a guiding roller 4. The associated force is referred to as pressing force A. Each drivable roller 4, 5 of a reduction stand 13-*i* has a drive 8 assigned to it, so that the respective rollers 4, 5 of the reduction stands 13-*i*, i=0 . . . 4, can be driven independently of one another. The drives 8 of the rollers 4, 5 of the reduction stands 13-*i* are in each case operatively connected to a control device 10, which controls the drives 8. Furthermore, the drives 8 comprise means 8" for detecting a drive load $I_{i\ ist}$ of an ith drive 8 of a reduction stand 13-*i*, i=0 . . . 4, which can be fed to the control device 10**.

Moreover, an ith reduction stand **13-*i*, i=0 . . . 4, has means 8' for detecting a rolling force which is exerted on the strand 2, wherein the detected rolling forces $F_i$ of the rolling roller 5 of the ith reduction stand 13-*i* can be fed to the control device 10**.

The rolling forces $F_i$ exerted on the strand 2 can be controlled by the control device 10. The rolling forces required to change the cast material 2 from an initial thickness 9 to a final thickness 9', and the distribution of the rolling forces over the reduction stands **13-*i*, i=0 . . . 4, for setting this final thickness 9', are conveyed to the control device 10 by way of a model which can be operated independently of the control device 10**.

In order to dispense with the need for an additional measuring device for measuring the casting speed of the cast material 2, the first reduction stand 13-0 in the succession of reduction stands **13-*i***, i=0 . . . 4, is used for setting and measuring the casting speed v.

Therefore, the first reduction stand 13-0 of the succession of reduction stands **13-*i*, i=0 . . . 4, does not have a rolling roller 5 above the strand 2 during the discharge of the strand 2, but merely a guiding roller 4. The reduction of the thickness 9 of the strand 2 is accomplished by the downstream reduction stands 13-1, 13-2, 13-3, 13-4. The control device 10 is formed in such a way that the rolling forces $F_1$, $F_2$, $F_3$, $F_4$ conveyed from the model are set on the reduction stands 13-1, 13-2, 13-3, 13-4** and a total force $F_{tot}$ is determined from the then detected rolling forces $F_1$, $F_2$, $F_3$, $F_4$.

Moreover, the loads $I_1$, $I_2$, $I_3$, $I_4$ of the drives A of the rolling rollers 5 are determined in the form of active currents $I_1$, $I_2$, $I_3$, $I_4$ acting in the drives A and used to calculate a total load $I_{tot}$ by summation. The control device 10 then controls the loads of the drives 8 in such a way that the load $I_i$ of an ith drive 8 of a rolling roller in relation to the total load $I_{tot}$ is the same as the rolling force $F_i$ exerted by this roller 5 on the strand in relation to the total force $F_{tot}$.

The first reduction stand 13-0, which during the guiding of the strand has no rolling rollers 5, but only guiding rollers 4, serves as a device for setting the casting speed or as a device for measuring the casting speed. Accordingly, depending on the process carried out by the roller, the guiding roller 4 arranged above the strand 2 is also referred to as the speed-setting roller 6 or as the measuring roller 7.

For setting the casting speed v or measuring the casting speed, the guiding roller 4, arranged above the strand 2, is pressed onto the cast material with a pressing force A. As a result, contact with the strand is ensured. However, the drive 8 of the roller 4, 6, 7 of this first reduction stand 13-0 is not controlled in the same way as the drives 8 of the rolling rollers 5. The drive 8 of this guiding roller 4 of the first reduction stand 13-0 is prescribed a load setpoint value, in order thereby to set a desired casting speed v. This desired casting speed v may, for example, be fed on the user side to the control device 10, which in response correspondingly controls the drive 8 of the speed-setting roller 6 of the reduction stand 13-0. The load $I_0$ of the drive 8 of the setting roller 6 of the first reduction stand 13-0 can be used for controlling the load $I_1$, $I_2$, $I_3$, $I_4$ of the drives 8 of the downstream rolling rollers 5. For this purpose, the load $I_0$ of the first drive is detected and fed to the control device 10. There, the detected load $I_0$ is processed by means of a PI controller 12 to form a control signal for the loads $I_1$, $I_2$, $I_3$, $I_4$ of the drives 8 assigned to the rolling rollers 5. This is of significance in particular whenever a measurement of the casting speed is to be performed by the measuring roller 7 of the first reduction stand 13-0.

With a casting system shown in FIG. 1 and a control device 10 comprised by the casting system, setting of a thickness of a cast material from an initial thickness 9 to a final thickness 9' can be performed without the casting speed exhibiting instabilities.

Figure 2:
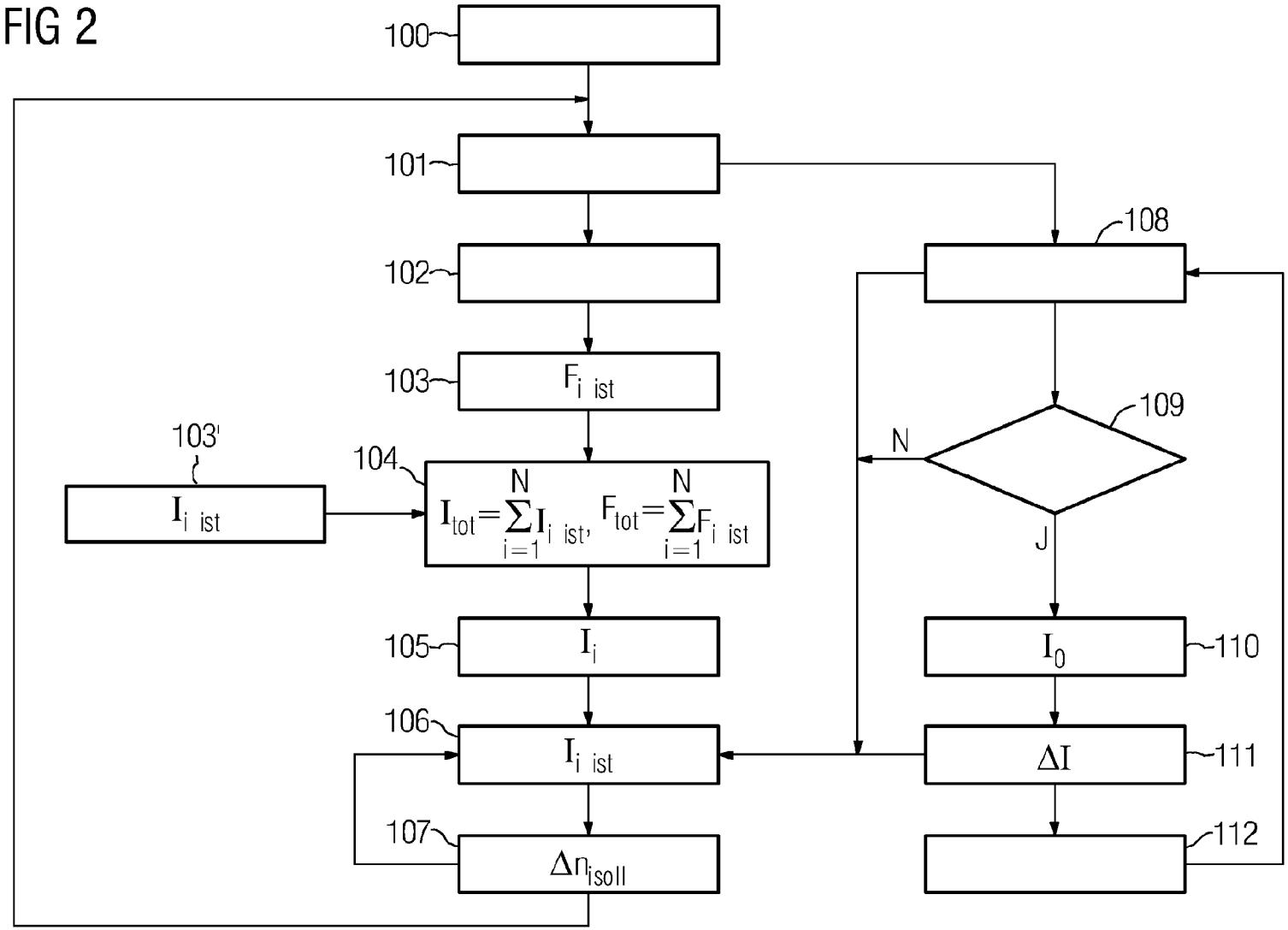
FIG. 2 shows a flow diagram to represent a sequence of the method according to an embodiment.

FIG. 2 is based on an initiated strand casting method. Available here is a model for determining a liquid core of the rolled stock, which determines the required rolling forces at the rolling rollers for setting a final thickness 9' when starting from an initial thickness 9. These determined rolling forces to be set are fed to a control device in a method step 100.

In FIG. 2 it is provided that a setting of the casting speed of the cast material is performed by a reduction stand, with which in principle a thickness reduction can also be performed. In the present case, this reduction stand is not used for the rolling, but for the setting and/or measuring of a casting speed of the cast material discharged from the casting chamber. Therefore, the guiding roller that is assigned to this reduction stand is also referred to as a measuring roller or as a roller setting the casting speed.

For this purpose, it is first established in a method step 101 which rollers are to be used as rolling rollers i or cannot be used on account of a defect. Subsequently, the control sets a rolling force $F_i$ for the respective ith rolling roller in a method step 102, the respective rolling force $F_i$ being dynamically prescribed by the aforementioned model. After setting of the rolling force $F_i$ on the respective rolling rollers, the rolling force $F_{i\,ist}$, the actual value of the rolling force of the ith roller, is detected in a method step 103. The detection and setting of the rolling force $F_{i\,ist}$ may take place substantially at the same time.

However, not only do the rolling rollers i exert a rolling force $F_i$ on the strand, but each rolling roller i is assigned a drive which drives the rolling roller such that the strand is moved further along a prescribed direction. For this purpose, a load $I_i$ is applied to the drive of a rolling roller i.

In a method step 103', an actual value of the load $I_{i\,ist}$ of each individual drive assigned to a rolling roller i is detected. In a method step 104, a total load $I_{tot}$ and a total rolling force $F_{tot}$ are determined from the detected rolling forces $F_{i\,ist}$ and the detected loads $I_{i\,ist}$ of the drives of the rolling rollers. This is achieved by the detected loads $I_{i\,ist}$ being summated. The total rolling force $F_{tot}$ is determined by the individual rolling forces $F_i$ that are exerted on the strand by the rolling rollers i being summated.

Subsequently, the (setpoint) load $I_i$ of the individual drives is determined from this, dependent on the rolling force $F_i$, in a method step 105. This takes place according to the relationship:

$$I_i = F_i \cdot \frac{I_{tot}}{F_{tot}}.$$

After determination of the (setpoint) load of the ith drive in proportion to the rolling force on the strand of the ith roller assigned to this drive, this load $I_{i\,ist}$ is set to the new value $I_i$ in a method step 106. The advancement of the strand by the rolling ith roller is improved by the rolling-force-dependent setting of the load. Moreover, there is no speed reduction due to changed frictional conditions on the strand resulting from a changed rolling force. In FIG. 1, i runs from 1 to 4.

However, the number i of rolling rollers can be chosen as desired, dependent on a respective casting system.

In the setting of the load of the drives of the rolling rollers in method step 106, allowance is advantageously made in a method step 108 for an intended measurement of the casting speed by the measuring roller or a changing of the casting speed by the speed-setting roller.

If a changed casting speed is to be set in a method step 108, it is advantageous that the load of the drives of the rolling rollers is controlled in a manner dependent on the detected load of the drive of the speed-setting roller. If the load of the drive assigned to the speed-setting roller rises, the loads of the drives of the rolling rollers are adapted more quickly to a changed casting speed.

Otherwise, the rolling rollers produce a resistance to the changing of the casting speed by an excessively low load of their drives. This is to be avoided by the drives assigned to the rolling rollers undergoing a control that is dependent on the load of the drive assigned to the roller setting the casting speed. Therefore, allowance is made in the setting of the loads in method step 106 for the setting of the casting speed in method step 108.

Moreover, it can be regularly inquired in a method step 109 whether a measurement of the casting speed of the cast material is to be performed. If a measurement of the casting speed is to take place with the measuring roller in a method step 111, it is expedient that the speed-measuring roller is relieved as much as possible in every operative direction by the downstream rolling rollers. This allows measurement that is as free from errors as possible to take place.

This can be achieved by the load of the speed-measuring roller being detected, and a load-offset value $\Delta I$ being determined for the load of the drives of the rolling rollers in dependence on the load of the speed-measuring roller by means of a PI controller in a method step 110. The load-offset value $\Delta I$, with which the drives assigned to the rolling rollers are controlled, can achieve the effect that the measuring roller is relieved substantially in all operative directions in the measurement. Once the load of the drives assigned to the rolling rollers has been set with allowance for the load-offset value $\Delta I$ in the setting of the loads in method step 106, a measurement of the casting speed with reduced measuring error can be realized.

After setting of the loads of the drives assigned to the rolling rollers, an additional rotational-speed setpoint value can be determined in a method step 107. By means of the additional rotational-speed setpoint value, the increase in speed of a portion of cast material that is brought about by the reduction of the thickness is included in the control of the rollers.

The method can be carried out continuously, with it being possible for the controls of the drives to be performed as part of a closed-loop control circuit. In particular, the method can be carried out until the casting of a cast material, for example a strand, is completed.

By the method according to various embodiments, the forward motion of the cast material can be improved, and the stability of the casting speed can be increased.

In particular, with such a method, continuous casting and rolling systems can be advantageously operated and, in particular, a casting system can be formed as a continuous casting and rolling system.

The invention claimed is:

1. A method for guiding a cast material out of a casting chamber of a casting system, the method comprising the steps of:

discharging the cast material from the casting chamber by means of a succession of guiding rollers and rolling rollers, exerting by a rolling roller a rolling force on the cast material to reduce the thickness of the cast material, wherein an only guiding roller exerts no rolling force on the cast material, and wherein at least the rolling rollers are driven by a drive, each drive applied under load, detecting the rolling force of each rolling roller, calculating a total rolling force as the sum of the detected rolling force for each rolling roller, detecting the load of each drive, calculating a total load as the sum of the detected load of each drive, determining a setpoint rolling force for a particular rolling roller, calculating a setpoint load to apply to the particular rolling roller based on the determined setpoint rolling force for the particular rolling roller, the calculated total rolling force, and the calculated total load, and applying the calculated set point load to the particular rolling roller.

2. The method according to claim 1, wherein the setpoint loads of the drives assigned to the rolling rollers are controlled relative to the total load in the same way as the setpoint rolling forces of the respectively assigned rolling rollers relate to the total rolling force.

3. The method according to claim 1, wherein an additional rotational-speed setpoint value is additionally determined for controlling the setpoint load of a drive, in order to adapt a rotational speed of a roller to a rolling-induced increase in the speed of a rolled portion of cast material.

4. The method according to claim 3, wherein the additional rotational-speed setpoint value is calculated according to $$\Delta n_{isoll} = p \cdot (I_{i\,ist} - I_i) \cdot \frac{n_N}{I_N},$$

where $I_{i\ ist}$ is the actual current of the ith drive, $I_i$ is the force-dependent setpoint value of the ith drive, p is a constant, $n_N$ is a nominal rotational speed and $I_N$ is a nominal current of the drive.

5. The method according to claim 1, wherein one of the guiding rollers is driven in such a way by a drive to which a load is applied and a pressing force not reducing the thickness of the cast material is exerted on the cast material in such a way that a prescribable casting speed of the cast material is set.

6. The method according to claim 5, wherein the casting speed is kept constant.

7. The method according to claim 5, wherein the setpoint loads of the drives of rollers arranged downstream of the roller setting the casting speed are controlled in dependence on the detected load of the drive assigned to the roller setting the casting speed.

8. The method according to claim 5, wherein the casting speed of the cast material is measured by means of the roller setting the casting speed.

9. The method according to claim 8, wherein the load of the drive assigned to the measuring roller is detected, and wherein from this a load-offset value for the setpoint loads of the drives assigned to rollers arranged downstream of the measuring roller is determined and the drives are controlled on the basis of this load-offset value.

10. The method according to claim 9, wherein, the load-offset value is determined by means of a PI controller.

11. The method according to claim 9, wherein the setpoint load of the drive assigned to the measuring roller is set to a prescribable, constant load value.

12. The method according to claim 1, wherein the torque of the drive is used as a measure of the load thereof.

13. The method according to claim 1, wherein the active current of the drive is used as a measure of the load thereof.

14. A control device for a casting system that discharges cast material from a casting chamber by means of a succession of guiding rollers and rolling rollers, wherein a rolling roller exerts a rolling force on the cast material to reduce the thickness of the cast material, wherein an only guiding roller exerts no rolling force on the cast material, and wherein at least the rolling rollers are driven by a drive, each drive applied under load, the control device being programmed by a machine-readable program code which is stored in non-transitory computer readable media and which comprises control commands programmed to:

detect the rolling force of each rolling roller, calculate a total rolling force as the sum of the detected rolling force for each rolling roller, detect the load of each drive, calculate a total load as the sum of the detected load of each drive, determine a setpoint rolling force for a particular rolling roller, calculate a setpoint load to apply to the particular rolling roller based on the determined setpoint rolling force for the particular rolling roller, the calculated total rolling force, and the calculated total load, and applying the calculated set point load to the particular rolling roller.

15. A computer program product for a control device of a casting system that discharges cast material from a casting chamber using a succession of rolling rollers each exerting a rolling force on the cast material to reduce the thickness of the cast material, and wherein at least the rolling rollers are driven by a drive, each drive applied under load, the computer program product stored in non-transitory computer readable media and executable to:

access a detected rolling force of each rolling roller, and a detected load of each drive, calculate a total rolling force as the sum of the detected rolling force for each rolling roller, calculate a total load as the sum of the detected load of each drive, determine a setpoint rolling force for a particular rolling roller, calculate a setpoint load to apply to the particular rolling roller based on the determined setpoint rolling force for the particular rolling roller, the calculated total rolling force, and the calculated total load, and applying the calculated set point load to the particular rolling roller.

16. A casting system for casting a cast material wherein the cast material can be discharged from a casting chamber by means of a succession of guiding rollers and rolling rollers acting on the cast material, wherein a rolling roller exerts a rolling force on the cast material to reduce the thickness of the cast material, wherein a guiding roller exerts no rolling force on the cast material, wherein at least the rolling rollers can be driven independently of one another, and comprising means for detecting a rolling force that is exerted on the cast material by one of the rolling rollers and a control device being programmed by a machine-readable program code which is stored in non-transitory computer readable media which comprises control commands programmed to:

calculate a total rolling force as the sum of a detected rolling force for each rolling roller, calculate a total load as the sum of a detected load of each drive, determine a setpoint rolling force for a particular rolling roller, calculate a setpoint load to apply to the particular rolling roller based on the determined setpoint rolling force for the particular rolling roller, the calculated total rolling force, and the calculated total load, and applying the calculated set point load to the particular rolling roller.

17. The system according to claim 16, wherein one of the guiding rollers is driven in such a way by a drive to which a load is applied and a pressing force not reducing the thickness of the cast material is exerted on the cast material in such a way that a prescribable casting speed of the cast material is set.

18. The system according to claim 17, wherein the setpoint loads of the drives of rollers arranged downstream of the roller setting the casting speed are controlled in dependence on the detected load of the drive assigned to the roller setting the casting speed.

19. The system, according to claim 17, wherein the casting speed of the cast material is measured by means of the roller setting the casting speed.

20. The system according to claim 19, wherein the load of the drive assigned to the measuring roller is detected, and wherein from this a load-offset value for the setpoint loads of the drives assigned to rollers arranged downstream of the measuring roller is determined and the drives are controlled on the basis of this load-offset value.

* * * * *